United States Patent [19]

Tsao-Tsung

[11] 4,244,085

[45] Jan. 13, 1981

[54] PIN FOR DOCUMENTS

[76] Inventor: Wei Tsao-Tsung, No. 12, Alley 63, Lane 149, Hua-Hsin Street, Chung-Ho Town, Taipei Hsien, Taiwan

[21] Appl. No.: 970,577

[22] Filed: Dec. 18, 1978

[51] Int. Cl.[3] ..... A44B 9/00

[52] U.S. Cl. ..... 24/85 C; 24/153

[58] Field of Search ..... 24/153 R, 161 R, 67.9, 24/85 C, 131 R

[56] References Cited

U.S. PATENT DOCUMENTS

| | | | |
|---|---|---|---|
| 430,903 | 6/1890 | Weil | 24/85 C |
| 1,734,653 | 11/1929 | Talisman | 24/85 C |
| 2,072,579 | 3/1937 | Brown | 24/131 R |
| 2,642,638 | 6/1953 | Larrabee | 24/153 R |
| 2,900,691 | 8/1959 | Morgan | 24/161 R |

FOREIGN PATENT DOCUMENTS

| | | | |
|---|---|---|---|
| 578037 | 6/1959 | Canada | 24/67.9 |

*Primary Examiner*—Kenneth Downey

[57] ABSTRACT

The present invention relates to an improved pin device which comprises a pinning means (hereinafter referred to as A means) and a fastening means (hereinafter referred to as B means). The present invention provides a fastener that does not loosen easily and slip off like an ordinary pin and can function both as a pin and a clip.

1 Claim, 4 Drawing Figures

PIN FOR DOCUMENTS

BACKGROUND OF THE INVENTION

The present invention relates to a device that pins securely and firmly sheets of paper and clips sheets of paper or cards like ordinary clips.

Ordinary pins, used to pin papers or documents, loosen and slip off easily after the papers or documents have been used and turned for a number of times, making the papers or documents loose and untidy, and fall apart if the pins slip off.

SUMMARY OF THE INVENTION

The main object of the present invention is to provide an improved pin device for pinning securely and firmly sheets of paper or documents by means of the interaction between the pinning means and the fastening means of the present invention so that the device will never slip off when it is pinned to the papers or documents, and does not get loose easily.

The second object of the present invention is to provide a pin means with an added fastening effect, using the device of the present invention.

The third object of the present invention is to provide a clip means, using the device of the present invention.

The objects and advantages of the present invention will be apparent from the following detailed description with reference to the accompanying drawings.

DETAILED DESCRIPTION OF THE INVENTION

Figure 1:
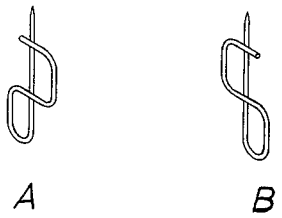
FIG. 1 is a perspective view of the present invention showing two preferred embodiments of the present device in their free state.

FIG. 1 is a perspective view of the present invention depicting the two preferred embodiments of the pin device comprising an A means and a B means. The device is made from a piece of wire which is stiff and elastic, and preferrably 0.8 mm to 0.9 mm in diameter, using a metallic wire reprocessing machine. The wire can be steel wire or any metallic wire which is stiff and elastic and low in cost, and is electroplated with metal to make it rust-proof. It is sharpened at one end and bent at a suitable position thereof into two segments, making a right angle or an acute angle between the segments; the sharpened segment is the A means which is similar to an ordinary pin without the head, and the other segment is the B means which is bent into an S form, which is an inverted S shape in the A embodiment and a regular S shape in the B embodiment. The structure of the present device is such that the front end section of the A means segment is in contact with the front end section of the B means segment with the B means segment superimposed on A means segment, and a gap of about 1 mm is maintained between the two segments at the perpendicular crossing thereof, to facilitate the change in position between the two front end sections during the engagement of the A means and the B means.

Figure 2:
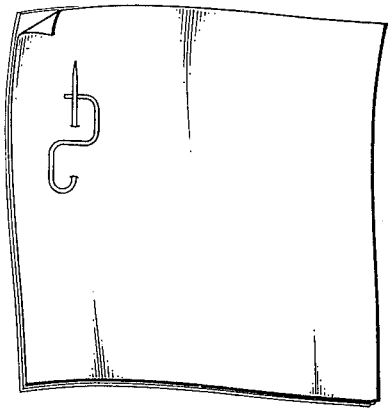
FIG. 2 is a perspective view of the present invention showing the present device pinned to a pile of papers and the engagement of the A means and the B means.

FIG. 2 depicts the device of the present invention pinned to a pile of papers with the A means and the B means properly engaged. To pin the papers, employing the A embodiment as shown in FIG. 1, first hold the lower section of the present device (the section below the perpendicular crossing) with the right hand, in a position paralled to the top surface of the papers, with the B means on top the A means and the thumb on top the device and the forefinger below the device, at the same time, hold the papers with the left hand; tilt the device a little bit and push forcefully the A means of the device into the paper to pierce the paper, with the thumb pressing against the crossing section of the B means to facilitate the piercing action, after the pin has passed under the paper for a suitable length, push the A means further to pierce the paper again to emerge from the papers with a suitable section of the A means coming above the paper. When the A means is in position, press the left side section of the B means segment against the paper with the left hand thumb, and hold the paper and the A means segment in position from below with the forefinger in cooperation with the thumb, both of the left hand, while maintaining a gap between the papers and the emerged section of the A means segment. After these actions have been completed, hold the right side section of the B means segment with the right hand thumb and forefinger, pull it to the right until the front end of the B means segment passes the emerged section of the A means segment, then press the front end section of the B means segment downward until it sinks below the emerged section of the A means segment and finally push lightly the right side section of the B means segment to the left until it passes under the emerged section of the A means segment and above the top surface of the papers, thus the front end section of the B means segment presses against the emerged section of the A means segment and comes in between the emerged section of the A means segment and the top surface of the papers and holds the A means tightly in position so that A means will not slip off under any circumstances. Alternately, one hand may be employed to carry out the fastening action. When A means segment is placed in position, employing the method described above, hold the papers and the A means segment from below with the left hand, press the left side section of the B means segment with the right hand thumb and push the right side section of the B means segment to the right with the right hand forefinger until the front end of B means segment passes the emerged section of the A means segment, then slightly press the right side section of the B means segment downward until it sinks below the emerged section of the A means segment, then release the B means segment, and due to elasticity of the wire, the front end section of the B means segment will move to the left to pass under the emerged section of the A means segment and above the top surface of the papers and presses the emerged section of the A means tightly in position. If the B embodiment is employed, simply change the direction of motion of the B means segment, and the hand side and repeat the same procedures. To remove the pin device from the papers when the A embodiment is employed, first pull the right side section of the B means segment to the right with the right hand until it passes the emerged section of the A means segment and release the B means segment, and it will return to its free position, and thereafter, pull the A means segment from the papers. If the B embodiment of FIG. 1 is employed, simply change the direction of motion of the B means segment and the hand side.

Figure 3:
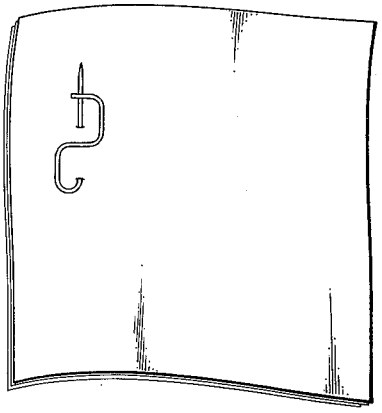
FIG. 3 is a perspective view of an embodiment of the present invention showing the present device used as a pin.

FIG. 3 depicts an embodiment of the present invention used as a pin which holds the papers more tightly because of the additional pressing effect provided by the B means segment.

Figure 4:
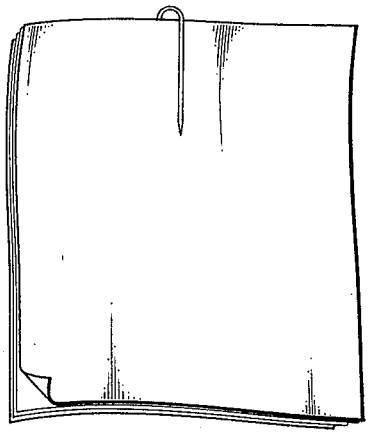
FIG. 4 is a perspective view of an embodiment of the present invention showing the present deviee used as a clip.

FIG. 4 depicts an embodiment of the present invention used as a clip. The clip is generally used for a thicker pile of paper with the B means segment holding the papers from the back and the A means segment holding the same from the front.

The present invention provides a device that holds paper securely and firmly together without the defect of slipping off after repeated and long period of use because of the fastening effect brought about by the engagement of the A means and the B means. Another characteristic of the present invention is the holding of papers in tidy position because of the stability provided by the right and left sections of the B means. Further, the present device can function both as a pin and a clip, and can be used also for cloth, cards and ornaments.

What is claimed is:

1. A pin device capable of performing both clipping and pinning functions, said device comprising a single piece of wire having one sharpened end and one blunt end and being bent into two segments; the first said segment being substantially straight and having the said sharpened end, the second said segment being bent through a first loop such that the wire in the second segment crosses said straight segment, said second segment being bent into a second loop in reverse direction to said first loop, so as to provide a second crossing of said straight segment near said sharpened end of the first segment, said second segment being generally S-shaped, with the said blunt end being substantially contained within the profile of the S and being positioned adjacent said sharpened end, said two loops of said second segment being substantially in the same plane and on the same side of said straight segment but being formed with curvature from the plane so as to provide a resiliently biased contact between said first and second segments at the point of said second crossing when in a first position, said bias contact providing retaining force for objects inserted between said segments whereby said device may be employed as a spring clip, said first and second loops being large enough to permit the said second segment to be elastically deformed in its plane until said blunt end of said second segment is removed from contact with said straight segment, permitting said blunt end to be elastically deformed out of the plane of the first loop, said blunt end subsequently being engaged on the side of said straight segment which is opposite to that of the said first position, the said blunt end being elastically moved to a second position wherein said second segment is parallel to its location in said first position, whereby said blunt end provides a retention clip for material which has been pierced by said straight segment functioning as a pin.

* * * * *